US007294035B2

(12) United States Patent
Hirata et al.

(10) Patent No.: US 7,294,035 B2
(45) Date of Patent: Nov. 13, 2007

(54) METHOD AND APPARATUS FOR WELDING SHROUD GLASS TUBE IN ARC TUBE FOR DISCHARGE LAMP

(75) Inventors: Masayasu Hirata, Shizuoka (JP); Hiromi Kubota, Shizuoka (JP); Shinya Misonou, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 339 days.

(21) Appl. No.: 11/124,239

(22) Filed: May 9, 2005

(65) Prior Publication Data

US 2005/0255783 A1 Nov. 17, 2005

(30) Foreign Application Priority Data

May 12, 2004 (JP) ..... P.2004-141970

(51) Int. Cl.
*H01J 9/00* (2006.01)
*H01J 9/26* (2006.01)
*H01J 9/36* (2006.01)

(52) U.S. Cl. ..... 445/66; 445/70; 445/73; 445/26; 445/43; 65/152; 65/153

(58) Field of Classification Search ..... 445/26, 445/66, 70, 73; 65/152, 153, 155, 35, 57
See application file for complete search history.

(56) References Cited

U.S. PATENT DOCUMENTS 4,389,201 A * 6/1983 Hansler et al. ..... 445/26
6,580,200 B2 * 6/2003 Fukuyo et al. ..... 313/34
6,790,115 B2 * 9/2004 Fukai et al. ..... 445/26
6,918,808 B2 * 7/2005 Fukuyo et al. ..... 445/26

FOREIGN PATENT DOCUMENTS

JP 2002-163980 A 6/2002

* cited by examiner

*Primary Examiner*—Mariceli Santiago
(74) *Attorney, Agent, or Firm*—Sughrue Mion, PLLC

(57) ABSTRACT

A method of secondarily welding one end of a shroud glass tube covering an arc tube body having a discharge emitting portion, having the other end welded primarily to one of the arc tube body ends, to the other end side of the arc tube body, while discharging air from, and introducing an inactive gas into, the tube through the opening end of the glass tube to hold a negative pressure. Heating and melting from a side is carried out. The opening end of the glass tube is connected to a piping passage component for discharging air and introducing an inactive gas through a rotatable magnetic fluid seal unit. Secondary welding is carried out with the rotation of the glass tube around an axis. The glass tube rotated with respect to secondary side heater is uniformly heated, molten and softened circumferentially, and welded along the arc tube body outer periphery.

6 Claims, 7 Drawing Sheets

METHOD AND APPARATUS FOR WELDING SHROUD GLASS TUBE IN ARC TUBE FOR DISCHARGE LAMP

The present invention claims foreign priority under 35 USC 119 based on Japanese patent application 2004-141970, the contents of which are incorporated herein by reference in their entirety. Further, this priority claim is being made concurrently with the filing of this patent application.

BACKGROUND

1. Technical Field

The present invention relates to a method and apparatus for manufacturing an arc tube for a discharge lamp in which a cylindrical shroud glass tube is welded integrally with the outer periphery of an arc tube body having a discharge emitting portion and an inactive gas space regulated to have a negative pressure is formed around the arc tube body, and more particularly to a method and apparatus for welding a shroud glass tube in an arc tube for a discharge lamp in which after a primary welding step of primarily welding one end side of the shroud glass tube to one end side of an arc tube body inserted and provided on a inside, the other end side of the shroud glass tube is secondarily welded to the other end side of the arc tube body while air is discharged from the tube through an opening portion on the other end of the shroud glass tube, and an inactive gas is introduced to hold the inner part of the tube to produce a negative pressure.

2. Background

As shown in FIG. 7, an arc tube has such a structure that a cylindrical shroud glass tube 4 for shielding ultraviolet rays is welded integrally with a bar-shaped arc tube body 2 including a closed glass bulb 2*a* that is a discharge emitting portion in the middle in a longitudinal direction. The closed glass bulb 2*a* is covered with the shroud glass tube 4 as is disclosed in Japanese patent publication JP-A-2002-163980. Ar gas is regulated to have a negative pressure, and is enclosed in a closed space 5 surrounding the arc tube body 2 formed by the shroud glass tube 4, thereby suppressing a devitrification phenomenon in the arc tube.

To manufacture the arc tube, the bar-shaped arc tube body 2 provided with the closed glass bulb 2*a* to be the discharge emitting portion in the central part of the longitudinal direction is fabricated. Next, the arc tube body 2 is inserted into the shroud glass tube 4 and one end side 4*b* of the shroud glass tube 4 is heated and molten, and is primarily welded (sealed) to one end side of the arc tube body 2 on the inside.

Subsequently, air is discharged from the inside of the shroud glass tube 4 through an opening portion on the other end of the tube 4, and Ar gas is introduced to hold the inner part of the tube 4 to have a negative pressure. At the same time, the other end side 4*a* is heated and molten, and is secondarily welded (shrink sealed) to the other end side of the arc tube body on the inside. Finally, the other end side of the shroud glass tube 4 is cut in a predetermined position if necessary.

In this arc tube, however, there is a disadvantage in that a shape in the secondary welding portion is not constant. At both of the primary and secondary welding steps, the shroud glass tube 4 is heated from sides respectively via a burner (heating means). The shroud glass tube 4 and the arc tube body 2 are held integrally and are welded (sealed) with the integral rotation of the shroud glass tube 4 and the arc tube body 2 with respect to the burner provided on the side at the primary welding step. At this time, it is necessary to discharge air from the inside of the tube through an opening portion on the other end of the shroud glass tube 4 and to introduce an Ar gas, thereby carrying out welding (shrink sealing) while holding the inside of the tube to have a negative pressure at the secondary welding step.

For at least this reason, it is impossible to weld both the shroud glass tube 4 and the arc tube body 2 with an integral rotation different from that of the primary welding step. Therefore, the welding is carried out such that both of the shroud glass tube 4 and the arc tube body 2 are fixed to the burner provided on the side.

Accordingly, the melting state of the shroud glass tube varies in a position opposed to the burner and the other position. As a result, there a first problem in that a shape and an adhesion in the secondary welding portion 4*a* becomes nonuniform in a circumferential direction, and the shape and adhesion of the secondary welding portion 4*a* might be varied for every arc tube which is manufactured, that is, a variation in the quality of the arc tube.

At the primary welding step and the secondary welding step, the support configurations of the shroud glass tube 4 and the arc tube body 2 are different from each other as described above. For this reason, the structures of the apparatus in the respective welding steps are different from each other, and the primary welding is carried out by an apparatus for the primary welding and the secondary welding is then carried out by an apparatus for the secondary welding. Thus, there is a second problem in that the size of equipment for the whole apparatus is correspondingly increased. Further, the workability is deteriorated.

SUMMARY OF THE INVENTION

It is an object of the present invention to provide a method and apparatus for welding a shroud glass tube in an arc tube for a discharge lamp, which can form a constant secondary welding portion having no variation for each product. However, the present invention can be achieved independently of this object. Further, there may be other objects or no objects as a part of the present invention.

One aspect of the invention is directed to a method of welding a shroud glass tube in an arc tube for a discharge lamp in which one end side of a shroud glass tube serving to cover an arc tube body provided with a discharge emitting portion in a middle in a longitudinal direction, disposed coaxially and having the other end side welded primarily to one end side of the arc tube body is welded secondarily to the other end side of the arc tube body on an inside by discharging air from the shroud glass tube through an opening end of the tube and introducing an inactive gas into the tube to hold an inner part of the tube to have a negative pressure, and at the same time, carrying out heating and melting from a side, wherein the opening end of the shroud glass tube is connected to a piping passage for discharging air and introducing an inactive gas through a relatively rotatable airtight seal coupling and the shroud glass tube is secondarily welded with a rotation around an axial center.

A second aspect of the invention is directed to an apparatus for welding a shroud glass tube in an arc tube for a discharge lamp, comprising an axially rotatable shroud glass tube holding portion which holds one end side of a shroud glass tube serving to cover an arc tube body provided with a discharge emitting portion in a middle in a longitudinal direction, disposed coaxially and having the other end side welded primarily to one end side of the arc tube body and maintains a communication of the shroud glass tube with a hollow shaft provided therein;

a relatively rotatable airtight seal coupling provided between the hollow shaft of the shroud glass tube holding portion and a piping passage component for discharging air and introducing an inactive gas;

a rotating and driving mechanism for rotating the shroud glass tube holding portion; and secondary heating means for heating, from a side, a position of the shroud glass tube held by the shroud glass tube holding portion in which secondary welding is to be carried out, wherein the air is discharged from the shroud glass tube and the inactive gas is introduced into the tube to hold an inner part of the tube to have a negative pressure, and at the same time, the shroud glass tube is heated and molten by the secondary heating means with a rotation of the shroud glass tube by means of the rotating and driving mechanism, thereby carrying out the secondary welding to an outer periphery at the other end side of the arc tube body.

(Function) At the second welding step for the shroud glass tube, the molten and softened region of the shroud glass tube is deformed to reduce a diameter inward in a radial direction by a negative pressure in the shroud glass tube and is thus welded to an outer peripheral surface on the other end side of the arc tube body (which will be hereinafter referred to as a shrink seal). The shroud glass tube is rotated around an axial center with respect to the secondary heating means from the side of the burner. Consequently, the shroud glass tube is uniformly heated, molten and softened in the circumferential direction, and is thus welded (shrink sealed) evenly along the outer periphery of the arc tube body on an inside to be rotated integrally with the shroud glass so that the external shape of the second welding portion conforms to the welded portion of the arc tube body. Consequently, the external shape of the secondary welding portion and a welding property in the circumferential direction of the secondary welding portion are not varied but are constant for each product.

Furthermore, the inner part of the airtight seal coupling for connecting the opening end of the shroud glass tube and the piping passage for discharging air and introducing an inactive gas to be relatively rotatable is reliably shielded from the air also during the rotation of the shroud glass tube by the airtight seal means provided in the relative rotating portion of the coupling. Consequently, the discharge of air from the shroud glass tube and the introduction of an inactive gas into the tube are carried out rapidly, and furthermore, a gas pressure in the tube is reliably held to have a negative pressure so that the shrink seal can be carried out quickly.

A third aspect of the invention is directed to an apparatus for welding a shroud glass tube in an arc tube for a discharge lamp, comprising an axially rotatable arc tube body holding portion which holds one end side of an arc tube body provided with a discharge emitting portion in a middle in a longitudinal direction;

an axially rotatable shroud glass tube holding portion provided opposite to the arc tube body holding portion in an axial direction and holding one end side of a shroud glass tube having the other end side welded primarily to one end side of the arc tube body to cover the arc tube body and disposed coaxially, and maintaining a communication of the shroud glass tube with a hollow shaft provided therein;

a relatively rotatable airtight seal coupling which is provided between the hollow shaft of the shroud glass tube holding portion and a piping passage component for discharging air and introducing an inactive gas;

a synchronous rotating and driving mechanism provided between the arc tube body holding portion and the shroud glass tube holding portion and serving to synchronously rotate the arc tube body holding portion and the shroud glass tube holding portion by means of a single driving motor; and secondary heating means for heating, from a side, a position of the shroud glass tube held by the shroud glass tube holding portion in which secondary welding is to be carried out, wherein the air is discharged from the shroud glass tube and the inactive gas is introduced into the tube to hold an inner part of the tube to have a negative pressure, and at the same time, the shroud glass tube is heated and molten by the secondary heating means with an integral rotation of the shroud glass tube and the arc tube body by means of the synchronous rotating and driving mechanism, thereby carrying out the secondary welding to an outer periphery at the other end side of the arc tube body.

In addition to the function according to the second aspect of the invention, there is the following function. The shroud glass tube which has one end side welded primarily to the one end side of the arc tube body to cover the arc tube body and is coaxially disposed is supported rotatably around the common axis of both the shroud glass tube holding portion and the arc tube body holding portion through the shroud glass tube holding portion on the opening end side and the arc tube body holding portion on the opposite side thereto (the primary welding portion side), respectively. At the secondary welding step, therefore, the shroud glass tube is rotated stably.

In the case in which only the shroud glass tube holding portion is to be rotated, furthermore, there is a possibility that an unexpected rotating torque might be generated in the primary welding portion. However, both of the holding portions are rotated synchronously by means of the synchronous rotating and driving mechanism. Therefore, the shroud glass tube is rotated without the generation of the unexpected rotating torque in the primary welding portion.

At the secondary welding step, therefore, the shroud glass tube is heated, molten and softened more uniformly in the circumferential direction, and is welded (shrink sealed) more evenly along the outer periphery of the arc tube body on the inside so that the external shape of the secondary welding portion accurately conforms to the welded portion of the arc tube body. Consequently, the external shape of the secondary welding portion and the welding property in the circumferential direction in the secondary welding portion are not varied but are still more constant for each product.

Moreover, the unexpected rotating torque is not generated in the primary welding portion during the rotation of the shroud glass tube. Therefore, the welding property of the primary welding portion can be prevented from being influenced badly.

Furthermore, a fourth aspect of the invention is directed to the apparatus for welding a shroud glass tube in an arc tube for a discharge lamp according to the second or third aspect of the invention, wherein the airtight seal coupling is constituted by the hollow shaft, the piping component assembled relatively rotatably into the hollow shaft through a bearing and forming a magnetic circuit in cooperation with the hollow shaft, and a magnetic fluid charged in a relative sliding and rotating portion of the hollow shaft and the piping component.

A coupling case (a case on a fixing side and a case on a rotating side) constituting the magnetic circuit is formed by the hollow shaft communicating with the inside of the shroud glass tube and the piping passage component for discharging air and introducing an inactive gas, and the relative sliding and rotating portion of the coupling case provided with the bearing is charged with the magnetic fluid so that a magnetic fluid seal is constituted. The magnetic fluid seal has a comparatively simple structure and the relative sliding and rotating portion has a low sliding resistance, and furthermore, the generation of dust is lessened, which is very effective for shielding the inner part of the coupling case from the air. At the secondary welding step, the magnetic fluid seal can reliably shield, from the air, the communicating portion of the hollow shaft of the shroud glass tube holding portion and the piping passage component for discharging air and introducing an inactive gas, and can carry out rapid and proper secondary welding (shrink seal).

If the airtight seal coupling is constituted by a magnetic fluid seal unit in which the relative rotating portion in inner and outer cylinder shafts assembled to be relatively rotatable through the bearing and forming the magnetic circuit in cooperation is charged with the magnetic fluid, and the internal cylinder shaft is fixed to the hollow shaft and the external cylinder shaft is fixed to the piping component, particularly, the airtight seal coupling (the magnetic fluid seal unit) can easily be assembled between the hollow shaft of the shroud glass tube holding portion and the piping passage component for discharging air and introducing an inactive gas.

A fifth aspect of the invention is directed to the apparatus for welding a shroud glass tube in an arc tube for a discharge lamp according to any of the second to fourth aspects of the invention, wherein a forming roller for forming a secondary welding portion of the shroud glass tube is provided in a predetermined position which corresponds to the secondary heating means and in which an operation of the heating means is not disturbed.

At the secondary welding step, the forming roller comes in contact with the secondary welding portion of the shroud glass tube to be rotated axially from the side. Consequently, the outer peripheral surface of the secondary welding portion of the shroud glass tube is molded to take an almost completely round shape having a predetermined diameter.

Moreover, it is also possible to constitute an apparatus for welding a shroud glass tube in an arc tube for a discharge lamp according to the invention, comprising:

an axially rotatable arc tube body holding portion which holds one end side of an arc tube body provided with a discharge emitting portion in a middle in a longitudinal direction;

a shroud glass tube holding portion which is provided opposite to the arc tube body holding portion in an axial direction, holds one end side of the shroud glass tube to maintain a communication with a hollow shaft provided therein and disposes the shroud glass tube coaxially with the arc tube body, and is axially rotatable and is relatively movable in an axial direction with respect to the arc tube body holding portion;

a relatively rotatable airtight seal coupling which is provided between the hollow shaft of the shroud glass tube holding portion and a piping passage component for discharging air and introducing an inactive gas;

a synchronous rotating and driving mechanism provided between the arc tube body holding portion and the shroud glass tube holding portion and serving to synchronously rotate the arc tube body holding portion and the shroud glass tube holding portion by means of a single driving motor;

primary and secondary heating means for heating, from sides, a position in which primary welding is to be carried out and a position in which secondary welding is to be carried out in the shroud glass tube held by the shroud glass tube holding portion respectively; and a forming roller provided in a predetermined position in which it does not interfere with the respective heating means and forming at least a primary welding portion of the shroud glass tube, wherein the arc tube body holding portion holding the arc tube body and the shroud glass tube holding portion holding the shroud glass tube are relatively moved in the axial direction to maintain a configuration in which the shroud glass tube covers the arc tube body, and the shroud glass tube is heated and molten by the primary heating means with an integral rotation of the shroud glass tube and the arc tube body by means of the synchronous rotating and driving mechanism, and is thus welded primarily to an outer periphery on one end side of the arc tube body, and a primary welding portion is formed by the forming roller, and then, air is discharged from the shroud glass tube and an inactive gas is introduced into the tube to maintain an inner part of the tube to have a negative pressure, and the shroud glass tube is heated and molten by the secondary heating means with the integral rotation of the shroud glass tube and the arc tube body by means of the synchronous rotating and driving mechanism, and is thus welded secondarily to an outer periphery on the other end side of the arc tube body, which has not been disclosed in the "claims".

According to such a structure, the primary welding step and the secondary welding step of the shroud glass tube can be carried out continuously by a single apparatus. Therefore, a conventional large-sized apparatus can be changed to be very compact, and furthermore, a workability can also be improved considerably.

According to the method of welding a shroud glass tube in an arc tube for a discharge lamp in accordance with the first aspect of the invention and the apparatus for welding a shroud glass tube in an arc tube for a discharge lamp in accordance with the second aspect of the invention, the shroud glass tube is heated uniformly in the circumferential direction and is molten and softened. Thus, the tube is thus welded (shrink sealed) uniformly and rapidly along the outer peripheral surface of the arc tube body on the inside to be rotated integrally with the shroud glass tube, and the external shape of the secondary welding portion always conforms to the welded portion of the arc tube body. Consequently, it is possible to manufacture an arc tube having substantially no variation in the secondary welding portion for each product manufactured.

According to the third aspect of the invention, the shroud glass tube is heated, molten and softened more uniformly in the circumferential direction and is thus welded (shrink sealed) more evenly around the outer peripheral surface of the arc tube body on the inside, and the external shape of the secondary welding portion always conforms to the welded portion of the arc tube body accurately. Therefore, it is possible to fabricate the arc tube having a smaller variation in the secondary welding portion for each product which is manufactured.

According to the fourth aspect of the invention, the secondary welding (shrink seal) can be carried out in such a configuration that the inner part of the shroud glass tube is regulated to have a constant negative pressure. Therefore, it is possible to fabricate an arc tube having no variation in a gas pressure enclosed in the shroud glass tube for each product which is manufactured.

According to the fifth aspect of the invention, the outer peripheral surface of the secondary welding portion of the shroud glass tube is molded to take an almost completely round shape having a predetermined diameter by means of the forming roller. Therefore, it is possible to fabricate an arc tube having no variation at all in the secondary welding portion for each product which is manufactured.

DETAILED DESCRIPTION OF THE EMBODIMENTS

An embodiment of the invention will be described below based on an example.

Figure 1:
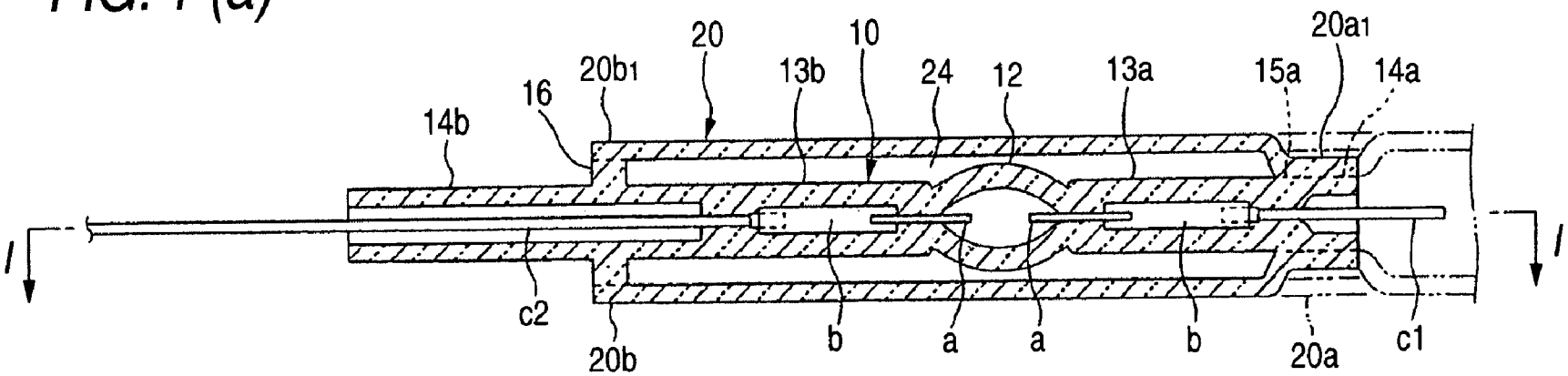
FIG. 1(*a*) is a longitudinal sectional view showing an arc tube welded according to an example of a method of welding a shroud glass tube in accordance with an embodiment, FIG. 1(*b*) is a longitudinal sectional view in an orthogonal position to the section shown in (a) of the arc tube (a sectional view taken along a line I-I in FIG. 1(*a*)
Figure 1:
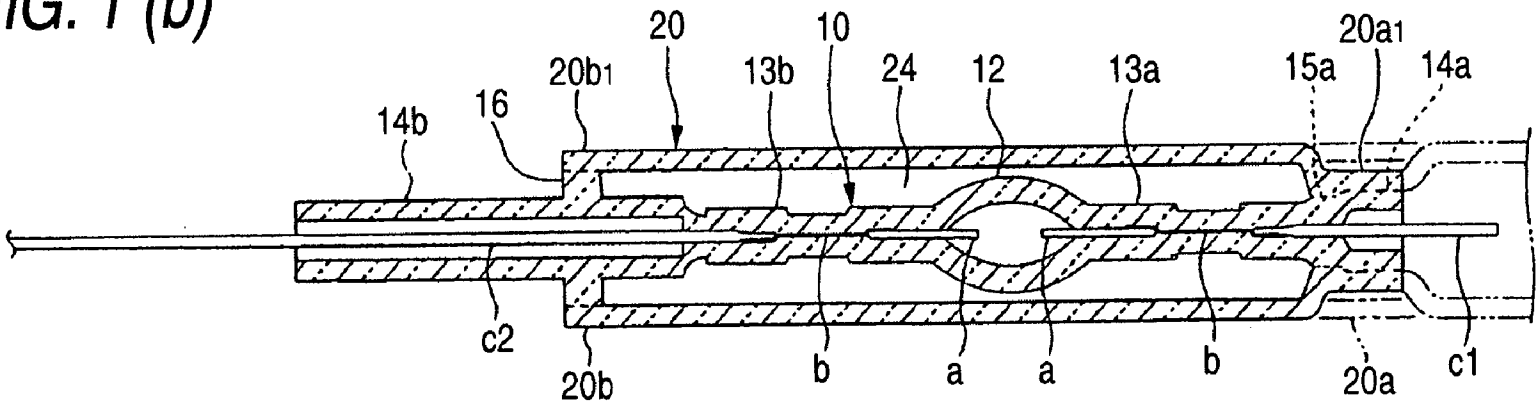
Figure 2:
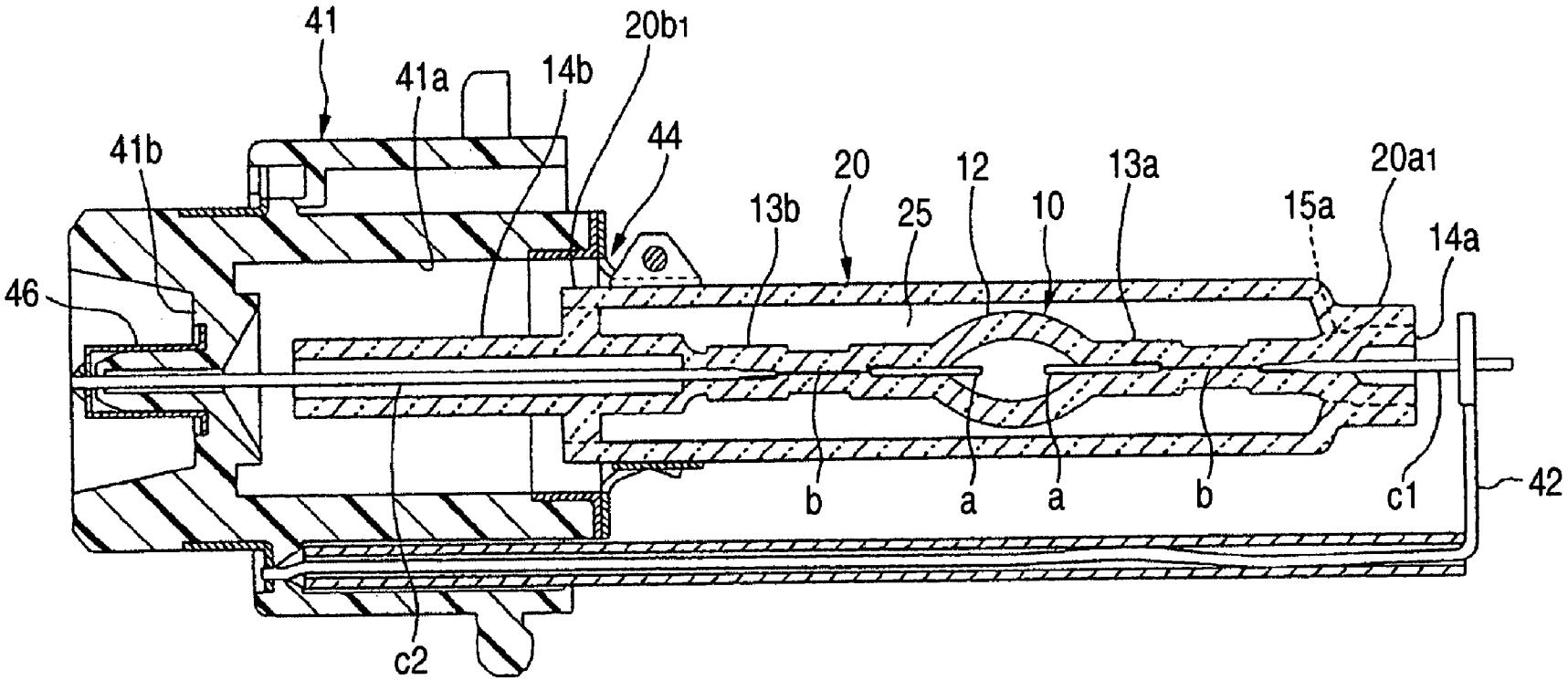
FIG. 2 is a longitudinal sectional view showing a discharge lamp device applying the arc tube.
Figure 3:
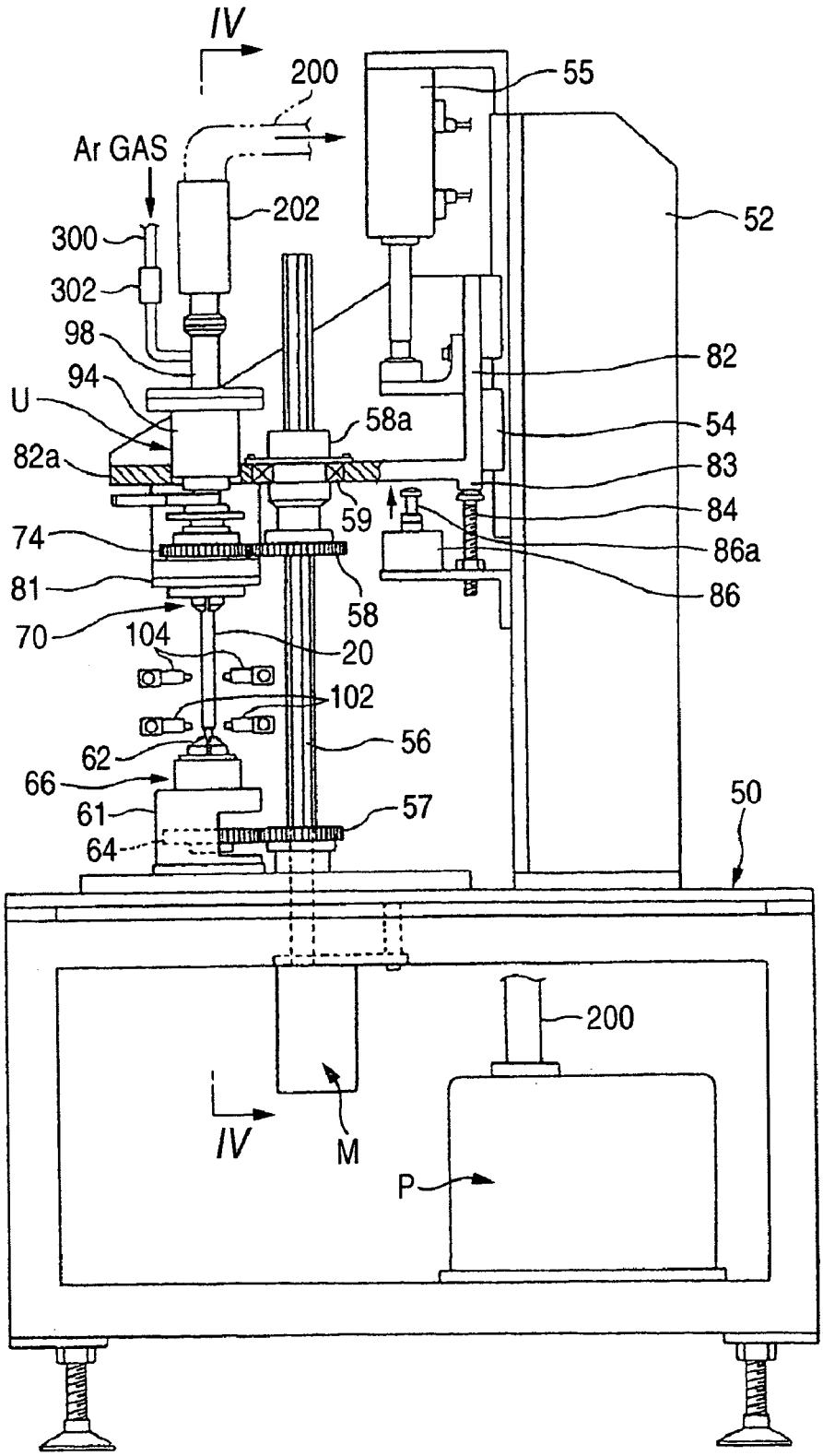
FIG. 3 is a side view showing an apparatus for welding a shroud glass tube to an arc tube body, a part of the apparatus illustrated in a sectional view.
Figure 4:
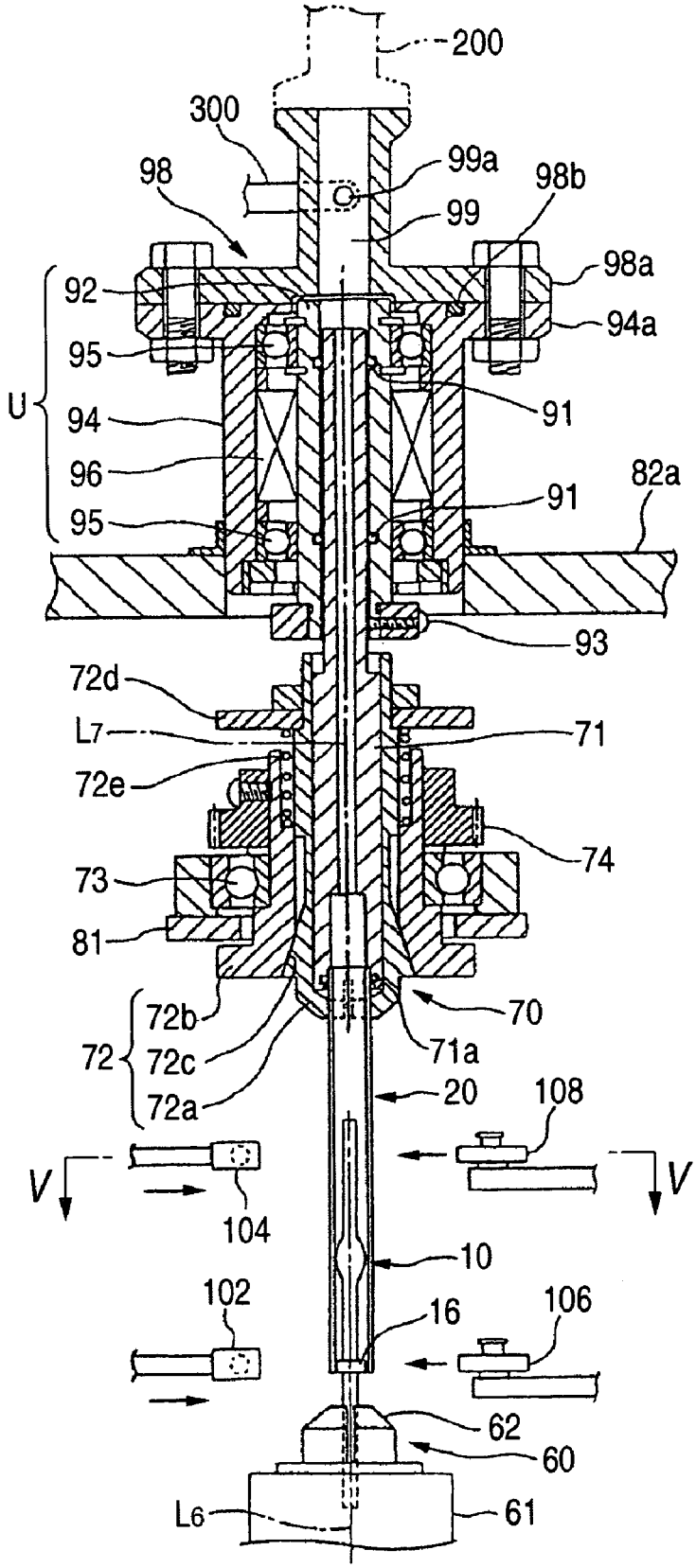
FIG. 4 is an enlarged sectional view showing the main part of the welding apparatus (a sectional view taken along a line IV-IV in FIG. 3)

FIGS. 1 to 6 show an exemplary, non-limiting method and apparatus for welding a shroud glass tube in an arc tube for a discharge lamp. FIG. 1 shows an arc tube welded according to the example of the method of welding a shroud glass tube in accordance with the invention, (a) being a longitudinal sectional view showing the arc tube and (b) being a longitudinal sectional view in an orthogonal position to the section shown in (a) of the arc tube (a sectional view taken along a line I-I in FIG. 1(*a*)). FIG. 2 is a longitudinal sectional view showing a discharge lamp device applying the arc tube, FIG. 3 is a side view showing a whole apparatus for welding a shroud glass tube to an arc tube body, a part of the apparatus being illustrated in a section, and FIG. 4 is an enlarged sectional view showing the main part of the welding apparatus (a sectional view taken along a line IV-IV in FIG. 3).

Figure 5:
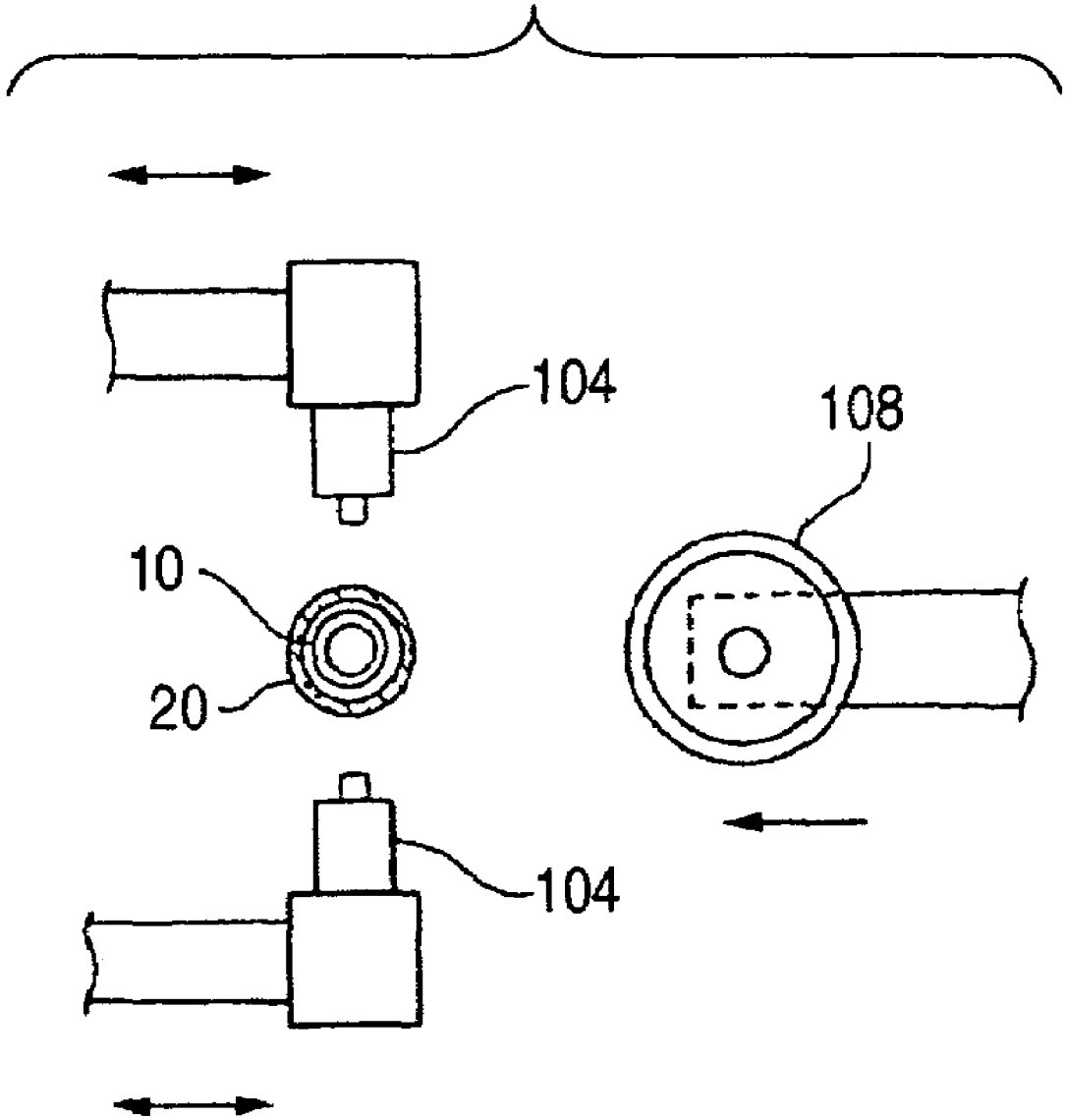
FIG. 5 is a horizontal sectional view showing the arrangement of a gas burner and a forming roller in the position of the shroud glass tube in which secondary welding is to be carried out (a sectional view taken along a line V-V in FIG. 4), FIG. 6(*a*) is a longitudinal sectional view showing an arc tube body manufactured through a process for manufacturing the arc tube body, FIG. 6(*b*) is a longitudinal sectional view showing a primary welding step of primarily welding a shroud glass tube to the arc tube body, FIG. 6(*c*) is a longitudinal sectional view showing a secondary welding step of secondarily welding the shroud glass tube subjected to the primary welding.
Figure 6:
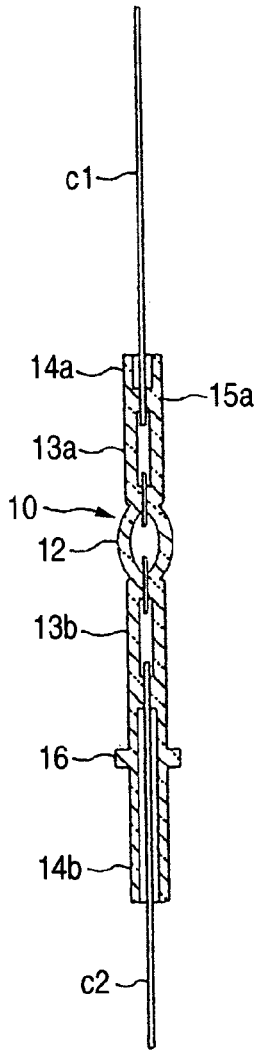
Figure 6:
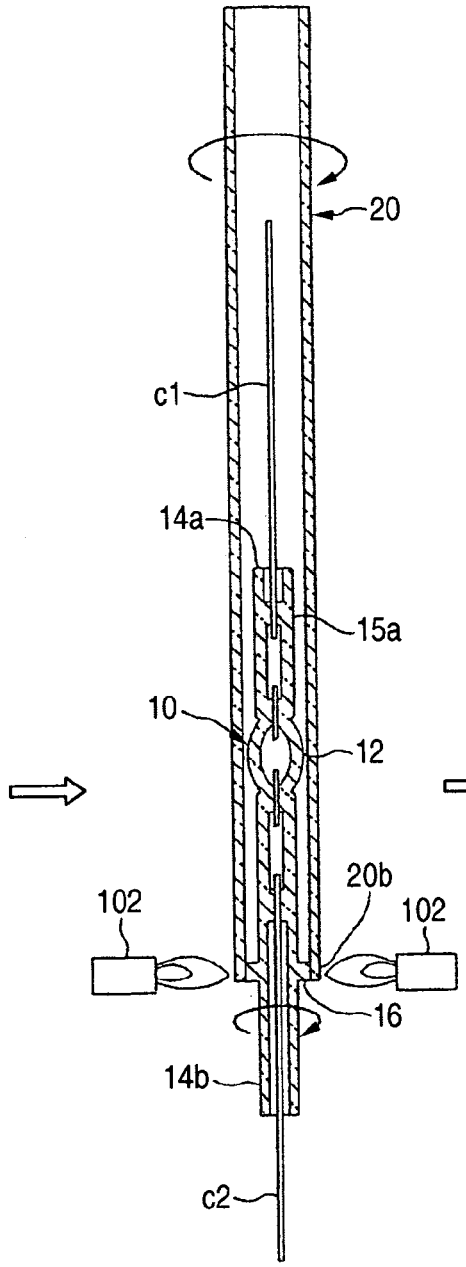
Figure 6:
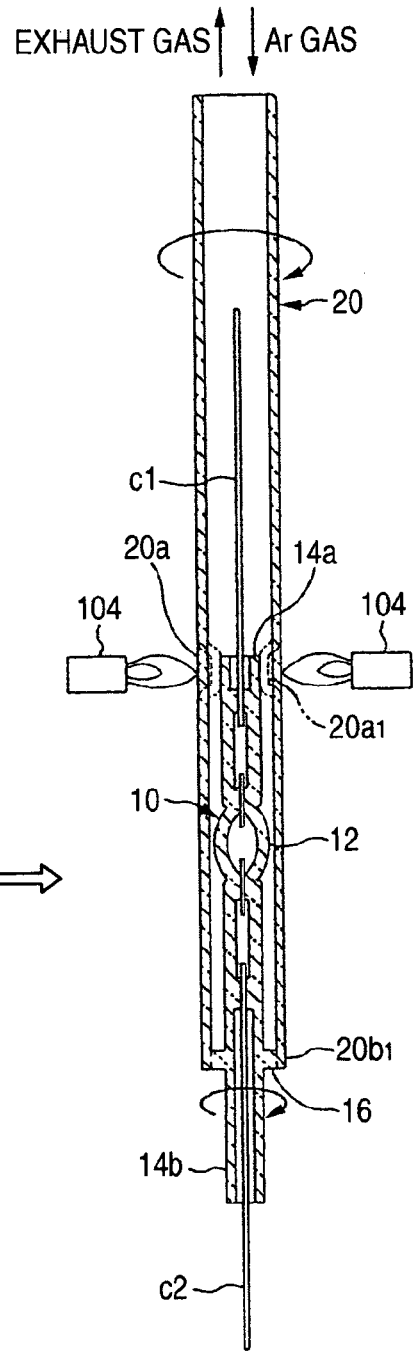
Figure 7:
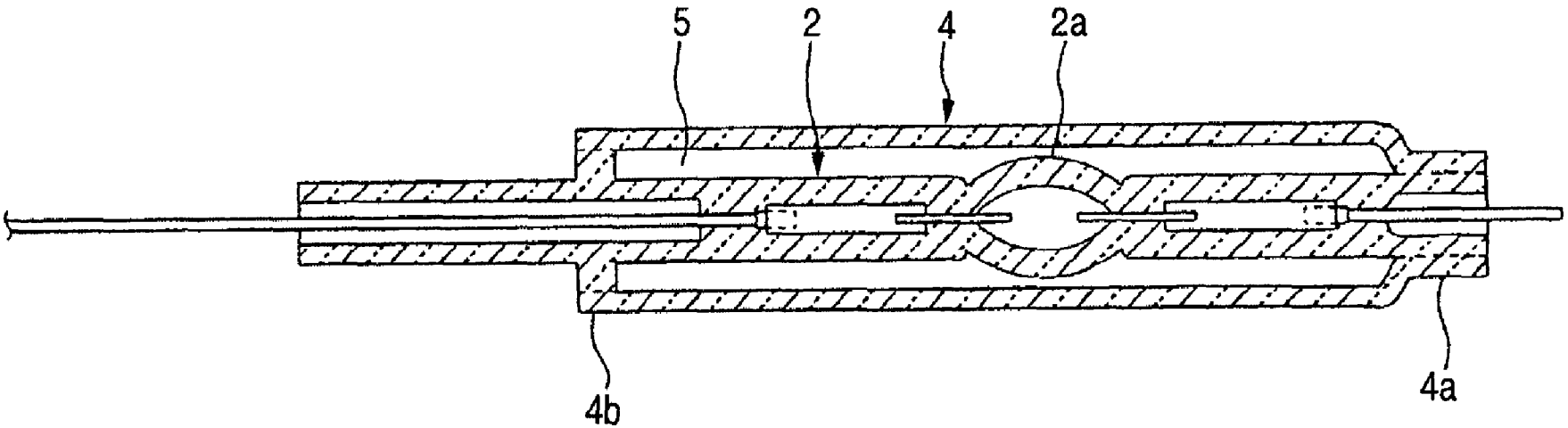
FIG. 7 is a longitudinal sectional view showing a background arc tube for a discharge lamp.

FIG. 5 is a horizontal sectional view showing the arrangement of a gas burner and a forming roller in the position of the shroud glass tube in which secondary welding is to be carried out (a sectional view taken along a line V-V in FIG. 4), and FIG. 6 is an explanatory view showing a process for welding the shroud glass tube, (a) being a longitudinal sectional view showing an arc tube body manufactured through a process for manufacturing the arc tube body, (b) being a longitudinal sectional view showing a primary welding step of primarily welding the shroud glass tube to the arc tube body, and (c) being a longitudinal sectional view showing a secondary welding step of secondarily welding the shroud glass tube subjected to the primary welding.

In FIGS. 1 and 6, an arc tube has such a structure that a cylindrical shroud glass tube 20 for shielding ultraviolet rays is welded integrally with an arc tube body 10 including a closed glass bulb 12 to be a discharge portion in a middle in a longitudinal direction. The closed glass bulb 12 is covered with the shroud glass tube 20.

The arc tube body 10 has a structure taking the shape of a bar. Pinch seal portions 13*a* and 13*b* having rectangular cross sections are formed before and after the closed glass bulb 12, and cylindrical portions 14*a* and 14*b* to be non-pinch seal portions are extended before and after the pinch seal portions 13*a* and 13*b*, respectively.

Electrodes a are opposed to each other, and a rare gas for starting, mercury and a metal halide (hereinafter referred to as light emitting substances) are enclosed in the closed glass bulb 12, which is sealed by the pinch seal portions 13*a* and 13*b*. Lead wires c1 and c2 connected to molybdenum foils b are led from the pinch seal portions 13*a* and 13*b* on both ends of the closed glass bulb 12 respectively. The lead wires c1 and c2 penetrating through the cylindrical portions 14*a* and 14*b* are extended in the longitudinal direction of the arc tube body 10.

A circular flange portion 16 for welding a rear end 20*b* of the shroud glass tube 20 is formed on the outer periphery of the cylindrical portion 14*b* at the rear end side of the arc tube body 10. A shrink seal portion 15*a* having a circular cross section for welding a front end side 20*a* of the shroud glass tube 20 is formed between the pinch seal portion 13*a* on the front end side and the cylindrical portion 14*a* in the arc tube body 10.

The rear end 20*b* of the shroud glass tube 20 is welded (primarily welded) to the circular flange portion 16 of the arc tube body 10. Furthermore, the front end side 20*a* of the shroud glass tube 20 is welded (secondarily welded) from the shrink seal portion 15*a* having a circular cross section to the cylindrical portion 14*a* in the arc tube body 10. As a result, a closed space 24 isolated from the air is formed around the arc tube body 10 (the closed glass bulb 12). The reference numeral 20*a*1 denotes a front end side welding portion (a secondary welding portion) of the shroud glass tube 20, and the reference numeral 20*b*1 denotes a rear end side welding portion (a primary welding portion) of the shroud glass tube 20.

In the welding portion 20*b*1 on the rear end side of the shroud glass tube 20, the weld to the circular flange portion 16 provided close to the inside of the rear end 20*b* of the shroud glass tube 20 is carried out as shown in FIGS. 1 and 6(*b*). Therefore, the rear end 20*b* of the shroud glass tube 20 which is heated, molten and softened is molten and bonded to the circular flange portion 16 on the inside substantially without a clearance.

In the welding portion 20*a*1 on the front end side of the shroud glass tube 20, a negative pressure is applied into the shroud glass tube 20 so that the region 20*a* to be welded in the shroud glass tube 20 which is heated, molten and softened by a gas burner 104 (heating means) is deformed to contract in a diameter-reducing direction by the negative pressure in the tube 20 as shown in FIG. 6(*c*). The region 20*a* is molten and bonded without a clearance from the shrink seal portion 15*a* having a circular cross section on the front end side of the arc tube body 10 to the outer peripheral surface of the cylindrical portion 14*a*, as shown in a virtual line in FIGS. 1 and 6(*c*).

A dry gas (for example but not by way of limitation, argon gas, to minimize the concentration of a water content after the discharge of the air) is enclosed in the closed space 24 divided by the shroud glass tube 20. In addition, the pressure in the closed space 24 is regulated to be approximately 1 atm. when the arc tube is ON at a high temperature, and approximately 0.5 atm. when the arc tube is OFF (an ordinary temperature). Consequently, the airtightness of the adiabatic closed space 24 in which the water content is rarely present can be guaranteed. Therefore, devitrification can be prevented from being generated on the arc tube (the closed glass bulb 12).

FIG. 2 shows a discharge lamp using the arc tube illustrated in FIG. 1. The front end of the arc tube is supported by a lead support 42 that protrudes forward from an insulating base 41. The rear end of the arc tube is supported by a concave portion 41*a* of the base 41. Further, a portion substantially close to the rear end of the arc tube is held by a metallic support member 44, which is fixed to the front surface of the insulating base 41.

The front end side lead wire c1 from the arc tube is fixed to the lead support 42 by welding. The rear end side lead wire c2 penetrates through a bottom wall 41*b* forming the concave portion 41*a* of the base 41 and is fixed, by welding, to a terminal 46 provided on the bottom wall 41*b*.

To manufacture the arc tube shown in FIG. 1, the bar-shaped arc tube body 10 comprising the closed glass bulb 12 shown in FIG. 6(*a*) is first manufactured in the tube body manufacturing process described in JP-A-2002-163980. The cylindrical portion 14*b* on the rear end side of the manufactured arc tube body 10 is provided with the circular flange portion 16 for easily performing the primary welding of the rear end 20*b* of the shroud glass tube 20.

At the subsequent step of welding the shroud glass tube both end sides of the shroud glass tube 20 for shielding ultraviolet rays are welded integrally with the arc tube body 10. As a result, an arc tube is manufactured that has a structure in which the arc tube body 10 is surrounded by the closed space 24 for an Ar gas regulated to have a negative pressure.

The step of welding the shroud glass tube is shown in FIGS. 6(*b*) and 6(*c*). First, the shroud glass tube 20 is prepared, having a larger inside diameter than the closed glass bulb 12 of the arc tube body 10. Then, as shown in FIG. 6(*b*) the arc tube body 10 is inserted into the shroud glass tube 20 set in a vertical state, and the shroud glass tube 20 and the arc tube body 10 are rotated integrally and substantially simultaneously. The rear end 20*b* of the shroud glass tube 20 is heated and molten by a gas burner 102 and is thus primarily welded to the circular flange portion 16 on the arc tube body 10 side. The surface of the welding portion 20*b*1 is thus formed via a forming roller 106 (see FIG. 4).

Next, as shown in FIG. 6(*c*), a gas substitution for forcibly discharging the air in the shroud glass tube 20 and supplying a dry gas (for example, Ar gas, to minimize the concentration of a water content after the discharge of the air) into the shroud glass tube 20 is carried out to hold a pressure in the tube at a negative pressure (for example, 0.5 atm.). At the substantially same time, the region 20*a* to be welded in the shroud glass tube 20 is heated and molten by means of the gas burner 104 with the integral rotation of the shroud glass tube 20 and the arc tube body 10, and is thus welded secondarily (shrink sealed) to the arc tube body 10.

More specifically, the region 20*a* to be welded in the shroud glass tube 20 which is heated, molten and softened, is deformed to contract in a diameter-reducing direction by a negative pressure in the tube 20 (see a virtual line in FIGS. 1 and 6(*c*)), and is molten and bonded without a clearance to the region from the shrink seal portion 15*a* to the cylindrical portion 14*a* on the front end side of the arc tube body 10 (see FIGS. 6(*a*) and 6(*b*)). Accordingly, the shrink seal portion (secondary welding portion) 20*a*1 of the shroud glass tube 20 is formed. The surface of the shrink seal portion 20*a*1 thus welded secondarily is formed by the forming roller 106 (see FIG. 4).

When the shroud glass tube 20 is cut in the position of the shrink seal portion 20*a*1, an arc tube is obtained in which the shroud glass tube 20 is welded integrally with the arc tube body 10 shown in FIG. 1.

FIGS. 3, 4 and 5 show a shroud glass tube welding apparatus to be used in the process for welding a shroud glass tube. The apparatus comprises an arc tube body holding portion 60 provided rotatably around an axis L6 on a base frame 50. Further, a shroud glass tube holding portion 70 supported on a vertical frame 52 provided perpendicularly to the base frame 50 is disposed coaxially just above the arc tube body holding portion 60, is rotatable around an axis L7, and can slide in a substantially vertical direction.

A collet chuck 62 opens upward and can hold the rear end side of the arc tube body 10. The collet chuck 62 is in the central part of the arc tube body holding portion 60. Furthermore, the whole arc tube body holding portion 60 is assembled through a bearing (not shown) rotatably around the axis L6 in a holding portion casing 61 fixed to the base frame 50.

A hollow shaft 71 extended vertically is provided in the central part of the shroud glass tube holding portion 70, and a collet chuck 72 holding the upper end side of the shroud glass tube 20 and opened downward is provided on the outer periphery of the lower end of the hollow shaft 71. Reference numeral 72*a* denotes a collet chuck body stopped by the hollow shaft 71 and rotated integrally with the hollow shaft 71. The collect chuck body 72*a* can slide substantially vertically along the hollow shaft 71. The reference numeral 72*b* denotes a collet chuck casing to be engaged with the outside of the collet chuck body 72*a*, and an engaging surface 72*c* provided between the body 72*a* and the casing 72*b* is constituted by a taper surface.

A compression coiled spring 72*e* is provided between a disc portion 72*d* fixed to the upper end of the body 72*a* and the casing 72*b*. When the disc portion 72*d* (and accordingly the body 72*a*) is pressed downward against the energizing force of the compression coiled spring 72*e*, a pressure contact state in the engaging surface 72*c* is cancelled so that the chuck (hold) of the shroud glass tube holding portion 70 by the collet chuck body 72*a* is released. An O ring 71*a* is attached to an inner peripheral surface on the lower end of the hollow shaft 71, with which the upper end of the shroud glass tube 20 can be engaged.

The shroud glass tube holding portion 70 (the collet chuck casing 72*b*) is rotatably assembled into a first horizontal frame 81 through a bearing 73. The first horizontal frame 81 is fixed to the lower surface of a horizontal plate portion 82*a* of a second L-shaped frame 82 supported on the vertical frame 52. Accordingly, the whole shroud glass tube holding portion 70 can be rotated around the axis L7 with respect to the first horizontal frame 81 (the base 50).

An air cylinder 55 is provided between the second L-shaped frame 82 which can slide in the vertical direction along the vertical frame 52, and the vertical frame 52 through an LM guide 54. As a result, the whole shroud glass tube holding portion 70 can slide in the vertical direction integrally with the frames 81 and 82. More specifically, at the step of welding the shroud glass tube 20, the shroud glass tube 20 supported (held) on the shroud glass tube holding portion 70 is brought downward from above the arc tube body 10 supported (held) on the arc tube body holding portion 60 so that the shroud glass tube 20 can be disposed so as to cover the arc tube body 10 as shown in FIGS. 3 and 4.

The reference numeral 84 in FIG. 3 denotes a stopper for setting the down position of the second L-shaped frame 82. A lower end 83 of the second L-shaped frame 82 abuts on the stopper 84, thereby setting a position in the vertical direction of the shroud glass tube 20 suspended and supported on the shroud glass tube holding portion 70 with respect to the arc tube body 10 (which is a position in which the region 20*b* to be primarily welded and the region 20*a* to be secondarily welded in the shroud glass tube 20 correspond to a position in which the arc tube body 10 is to be welded).

The reference numeral 86 denotes an air cylinder for slightly lifting the second L-shaped frame 82 (for example, about 5 mm) immediately before the start of the shrink seal at the secondary welding step, which serves to carry out the shrink seal rapidly. More specifically, the region 20*a* to be welded in the shroud glass tube 20 which is heated, molten and softened by means of the burner 104 is deformed to contract in a diameter reducing direction by a negative pressure in the shroud glass tube 20, and is thus shrink sealed as shown in a virtual line of FIG. 6(*c*).

When the air cylinder 86 is operated to slightly lift the shroud glass tube holding portion 70 by means of a cylinder rod 86*a* as shown in an arrow of FIG. 3 to pull the upper end side of the shroud glass tube 20 upward, the region 20*a* to be secondarily welded, which is molten and softened in the shroud glass tube 20, is pulled upward and thinned. Correspondingly, the function of reducing the diameter of the molten portion by the negative pressure is promoted so that a time required for the shrink seal can be shortened.

Driven spur gears 64 and 74 are fastened to the arc tube body holding portion 60 and the shroud glass tube holding portion 70 respectively. A vertical spline shaft 56 rotated by a driving motor M fixed to the base frame 50 and is extended perpendicularly is supported rotatably on the base frame 50 through a bearing (not shown). Further, the driving motor M has a driving spur gear 57 engagable with the driven spur gear 64 of the arc tube body holding portion 60, which is fastened to a lower end side thereof. A driving spur gear 58 which is engaged with the driven spur gear 74 and can slide in an axial direction is provided in the position of the vertical spline shaft 56, which corresponds to the driven spur gear 74 of the shroud glass tube holding portion 70.

More specifically, a cylindrical spline engaging shaft 58*a* in the driving spur gear 58 is engaged to be relatively movable in the axial direction with the vertical spline shaft 56. Further, the driving spur gear 58 is supported rotatably on the horizontal plate portion 82*a* of the second L-shaped frame 82 through a bearing 59. For this reason, the second L-shaped frame 82 (the shroud glass tube holding portion 70) can be caused to slide integrally in the vertical direction along the vertical spline shaft 56 with the engaging state of the driving spur gear 58 and the driven spur gear 74 on the shroud glass tube holding portion 70 side maintained by the operation of the air cylinder 55.

The rotation of the motor M fixed to the base frame 50 synchronously rotates the arc tube body holding portion 60 and the shroud glass tube holding portion 70 through the vertical spline shaft 56, the driving spur gears 57 and 58, and the driven spur gears 64 and 74. Therefore, the arc tube body 10 and the shroud glass tube 20 which are held by the arc tube body holding portion 60 and the shroud glass tube holding portion 70 are rotated integrally with each other.

Accordingly, welding is performed while the shroud glass tube 20 and the arc tube body 10 are rotated integrally with respect to the heating means provided on the side at the second welding step, in addition to the first welding step. Therefore, the shroud glass tube 20 is heated, molten and softened uniformly in a circumferential direction so that it is evenly welded along the outer periphery of the arc tube body 10 that is inside with respect to the shroud glass tube. The arc tube body 10 is rotated integrally with the shroud glass tube 20. In particular, the external shape of the secondary welding portion 20*a*1 subjected to the shrink seal conforms to the welded portion of the arc tube body 10.

Moreover, a magnetic fluid seal unit U is an airtight seal coupling provided between the hollow shaft 71 of the shroud glass tube holding portion 70 and a piping passage component 98 for discharging air and introducing an inactive gas. The piping component 98 is fixed to the horizontal plate portion 82*a* of the second frame 82, and a relatively rotatable communicating path provided between the hollow shaft 71 that communicates with the shroud glass tube 20 and a piping passage 99, for discharging air and introducing an inactive gas in the piping passage component 98, is reliably shielded from the air. The reference numeral 99*a* denotes an Ar gas supply port.

More specifically, the magnetic fluid seal unit U includes an inner cylinder shaft 92 and an outer cylinder shaft 94 assembled to be relatively rotatable via a bearing 95 and constitute a magnetic circuit in cooperation. The magnetic fluid sealing unit U also includes a magnetic fluid 96 attached to a relative sliding and rotating portion between both of the shafts 92 and 94. The inner cylinder shaft 92 is fixed to the outer periphery of the hollow shaft 71 and a flange portion 94*a* of the outer cylinder shaft 94, which is fixed to the horizontal plate portion 82*a* of the second frame 82. The outer cylinder shaft 94 is also fixed to a flange portion 98*a* of the piping passage component 98. As a result, the magnetic fluid seal unit U can easily be assembled between the hollow shaft 71 and the piping passage component 98.

In detail, the inner cylinder shaft 92 of the magnetic fluid seal unit U is fitted through an O ring 91 that is a seal member, and is fixed with a screw 93 to the outer periphery of the upper end of the hollow shaft 71 in the shroud glass tube holding portion 70. On the other hand, an air discharge piping 200 extended from a vacuum pump P (see FIG. 3) and an Ar gas supply piping 300 are coupled to the piping passage component 98 through valves 202 and 302, respectively. The flange portion 94*a* of the outer cylinder shaft 94 in the magnetic fluid seal unit U is fastened to the flange portion 98*a* of the piping passage component 98 with a screw through an O ring 98*b* that is a seal member.

As shown in FIGS. 3 and 5, the primary gas burner 102 that is the primary heating means and the secondary gas burner 104 that is the secondary heating means, which make a pair on left and right sides, are provided on the sides of the shroud glass tube 20 held in the shroud glass tube holding portion 70 (both of the left and right sides in FIG. 3), corresponding to the positions in which the primary welding and the secondary welding are to be carried out, respectively. The primary gas burner 102 and the secondary gas burner 104 can carry out a sliding operation in a longitudinal direction (a perpendicular direction to the paper in FIG. 3 and a transverse direction in FIG. 4) from a position placed apart from the shroud glass tube 20 to a closer position to the shroud glass tube 20, respectively.

As shown in FIG. 4, the primary gas burner 102 and the secondary gas burner 104 are substantially level with each other. The primary forming roller 106 and a secondary forming roller 108 which can carry out a sliding operation in the longitudinal direction (the transverse direction in FIG. 4) respectively are provided in positions on the side of the shroud glass tube 20 (the right side in FIG. 4) that do not interfere with the operations of the respective gas burners 102 and 104. The forming rollers 106 and 108 come in contact, from the side, with the primary welding portion 20*b* of the shroud glass tube 20 which is obtained immediately after the primary welding and the secondary welding portion 20*a* obtained immediately after the secondary welding, respectively. Consequently, the outer peripheral surfaces of the primary welding portion 20*b* and the secondary welding portion 20*a* in the shroud glass tube 20 are formed to take substantially round shapes having respective diameters.

The magnetic fluid seal unit U having the magnetic fluid 96 provided in the region interposed with a pair of bearings 95 and 95 in the relative sliding portion (rotating portion) between the inner and outer cylinder shafts 92 and 94 is assembled between the hollow shaft 71 and the piping passage component 98 in this exemplary embodiment. However, it is also possible to employ a magnetic fluid seal structure in which the bearings 95 and 95 and the magnetic fluid 96 are provided between the intermediate shaft 71 and the outer cylinder shaft 94 that constitute the magnetic circuit.

The shroud glass tube holding portion 70 supporting the shroud glass tube 20 is caused to slide in the substantially vertical direction with respect to the arc tube body holding portion 60 supporting the arc tube body 10 in the example. However, it is also possible to employ a structure in which the arc tube body holding portion 60 supporting the arc tube body 10 is caused to slide in the substantially vertical direction with respect to the shroud glass tube holding portion 70 supporting the shroud glass tube 20. When the arc tube body holding portion 60 is caused to slide in the vertical direction, it is desirable to employ a structure in which a tractive force acts on the region to be secondarily welded which is molten and softened, in order to shorten the time required for the shrink seal, by slightly moving the arc tube body holding portion 60 downward immediately before the start of the shrink seal at the second welding step.

The arc tube body 10 is supported on the lower arc tube body holding portion 60 and the shroud glass tube 20 is supported by the upper shroud glass tube holding portion 70 in the example. Furthermore, it is possible to employ a structure turned upside down from that in the example. For example, a structure may be provided in which the arc tube body 10 is supported on the upper arc tube body holding portion 60, and the shroud glass tube 20 is supported on the lower shroud glass tube holding portion 70.

Additionally, the primary welding and the secondary welding are carried out with the arc tube body 10 and the shroud glass tube 20 set in a vertical state in the example. However, it is also possible to employ a structure in which the primary welding and the secondary welding are performed with the arc tube body 10 and the shroud glass tube 20 set in a substantially horizontal or oblique state.

Also, the secondary welding portion 20*a*1 obtained immediately after the secondary welding is formed by means of the forming roller 108 in the example. However, the secondary welding can be carried out by means of the shrink seal, so that the forming roller 108 for forming the secondary welding portion 20*a*1 is not always required.

Further, the rear end 20*b* of the shroud glass tube 20 is welded to the circular flange portion 16 formed on the outer periphery of the cylindrical portion 14*b* at the rear end side of the arc tube body 10 at the primary welding step in the example. However, the diameter of the region on the rear end side of the shroud glass tube which is heated, molten and softened may be reduced by means of the forming roller, and may be thus welded directly to the cylindrical portion 14*b* on the rear end side of the arc tube body 10, as in other conventional structures.

While the invention has been described above with reference to the embodiment, the technical range of the invention is not restricted to the range described in the embodiment. It is apparent to the skilled in the art that various changes or improvements can be made in the embodiment. It is apparent from the appended claims that the embodiment thus changed or improved can also be included in the technical range of the invention.

The invention claimed is:

1. An apparatus for welding a shroud glass tube disposed coaxially with and covering an arc tube body having a substantially centrally and longitudinally displaced discharge emitting portion therein, a first end side of the shroud glass tube welded primarily to a first end side of the arc tube body, said apparatus comprising:

an axially rotatable shroud glass tube holding portion that holds the first end side of the shroud glass tube, and maintains communication with a hollow shaft of the shroud glass tube;

a relatively rotatable airtight seal coupling between the hollow shaft and a piping passage component configured to maintain a negative pressure at an inner part of the shroud glass tube by discharging air and introducing an inactive gas;

a rotating and driving mechanism that rotates the shroud glass tube holding portion; and means for heating a secondary welding portion at the first end side of the shroud glass tube held by the shroud glass tube holding portion, wherein said secondary welding between an outer periphery at a second end side of the arc tube body and the secondary welding portion occurs when the negative pressure is maintained substantially simultaneously with (a) said heating means heating and melting the shroud glass tube and (b) said rotating and driving mechanism rotating the shroud glass tube.

2. The apparatus according to claim 1, wherein the airtight seal coupling comprises the hollow shaft, the piping passage component assembled relatively rotatably into the hollow shaft via a bearing and comprising a magnetic circuit in cooperation with the hollow shaft, and a magnetic fluid charged in a relative rotating portion of the hollow shaft and the piping passage component.

3. The apparatus according to claim 1, wherein a roller that forms a secondary welding portion of the shroud glass tube is positioned corresponding to the secondary heating means, and operation of the heating means is not disturbed.

4. An apparatus for welding a shroud glass tube in an arc tube, comprising:

an axially rotatable arc tube body holding portion that holds a first end side of an arc tube body having a centrally and longitudinally positioned discharge emitting portion;

an axially rotatable shroud glass tube holding portion opposite the arc tube body holding portion in an axial direction, and holding a first end side of a shroud glass tube having its second end side welded primarily to the first end side of the arc tube body so as to cover the arc tube body and being disposed coaxially therein, said shroud glass tube holding portion maintaining communication with a hollow shaft in the shroud glass tube;

a rotatable airtight seal coupling provided between the hollow shaft and a piping passage component that discharges air and introduces an inactive gas to generate a negative pressure;

a driving motor that synchronously rotates the arc tube body holding portion and the shroud glass tube holding portion; and means for secondarily heating a side position at said second end side of the shroud glass tube held by the shroud glass tube holding portion, wherein secondary welding occurs when negative pressure is generated substantially simultaneously (a) with the means for secondarily heating, heating and melting the shroud glass tube and (b) the driving motor integrally rotating the shroud glass tube and the arc tube body.

5. The apparatus according to claim 4, wherein the airtight seal coupling comprises the hollow shaft, the piping passage component assembled relatively rotatably into the hollow shaft through a bearing and comprising a magnetic circuit in cooperation with the hollow shaft, and a magnetic fluid charged in a relative rotating portion of the hollow shaft and the piping passage component.

6. The apparatus according to claim 4, wherein a roller forms a secondary welding portion of the shroud glass tube and is positioned with respect to the secondary heating means, and wherein an operation of the heating means is not disturbed.

* * * * *